United States Patent [19]

Romanski et al.

[11] 4,015,038

[45] * Mar. 29, 1977

[54] NOVEL HIGH TEMPERATURE RESISTANT FABRICS

[75] Inventors: Eric R. Romanski, Delmar; J. Drew Horn, Kinderhook; William H. Dutt, Rensselaer, all of N.Y.

[73] Assignee: Albany International Corporation, Albany, N.Y.

[ * ] Notice: The portion of the term of this patent subsequent to Mar. 18, 1992, has been disclaimed.

[22] Filed: Feb. 24, 1975

[21] Appl. No.: 552,765

Related U.S. Application Data

[63] Continuation-in-part of Ser. No. 420,431, Nov. 30, 1973, Pat. No. 3,871,946.

[52] U.S. Cl. ..... 428/255; 28/74 R; 28/75 R; 74/232; 74/239; 428/257; 428/258; 428/259; 428/375

[51] Int. Cl.[2] ..... B32B 5/02; D03D 19/00

[58] Field of Search ..... 28/74 R, 75 R; 139/383 R, 419, 420 R; 74/231 R, 232, 239; 428/255, 257, 258, 259, 375

[56] References Cited

UNITED STATES PATENTS 3,871,946 3/1975 Romanski et al. ..... 28/75 R

*Primary Examiner*—James J. Bell
*Attorney, Agent, or Firm*—Kane, Dalsimer, Kane, Sullivan and Kurucz

[57] ABSTRACT

A novel open weave endless dryer belt is disclosed which comprises in a leno weave, warp yarns of synthetic organic fibers and crosswise yarns of synthetic organic fibers braided over a core of glass fibers and/or metal wire. The fabric weave is then finished with a coating of a temperature resistant resin. The fabric of the invention is useful for fabricating conveyor belts employed in conveying textiles through dryers and in like applications.

12 Claims, No Drawings

NOVEL HIGH TEMPERATURE RESISTANT FABRICS

CROSS-REFERENCE TO RELATED APPLICATIONS

This application is a continuation-in-part of U.S. application Ser. No. 420,431, filed Nov. 30, 1973, now issued as U.S. Pat. No. 3,871,946.

BACKGROUND OF THE INVENTION

1. Field of the Invention

The invention concerns temperature resistant synthetic fabrics and more particularly concerns a temperature resistant, coated open weave fabric and dryer belts made therefrom.

2. Description of the Prior Art

The requirements for dryer belts have become more and more demanding as the textile industry continues to evolve. The demand for faster machine throughputs, and more complete solvent recoveries to meet pollution requirements in the textile industry have created a demand for dryer belts with a high percentage of projected open area and which will tolerate the more severe conditions without a significant reduction in operating life.

Prior hereto, metal mesh belts have been employed as dryer belts in textile dryers. However, the metal belts exhibit poor flex fatigue resistance and track poorly, particularly when run at high speeds. Also, over a relatively short period of time, small wire strands break and bend leaving a sharp point which will catch and damage the textile being conveyed.

Synthetic dryer belts employed previously have included, for example, fiberglass fabrics coated with polytetrafluoroethylene. These synthetic fabrics generally enjoy short lives as dryer belts, having a relatively poor resistance to abrasion, relatively low strength and poor tracking ability at high speeds.

Open weave nylon Fourdrinier wires have been employed extensively in papermaking, particularly nylon fabrics coated with phenolic-aldehyde resins (see for example, U.S. Pat. No. 3,032,441). Although such fabrics are excellent in terms of their durability and long life they generally have low air permeability and therefore are of limited value where a high volume of air passage is desired (as is the case of dryer belts for the drying of textiles).

The leno weave is a known weave which has been previously employed to fabricate support fabrics such as skrim (U.S. Pat. No. 3,595,730) and insulating wrappings (U.S. Pat. No. 2,679,677).

We have found that a particular open weave, employing particular warp and weft yarns coated with particular types of resin compositions yield fabrics particularly valuable for dryer belts. The dryer belts fabricated from the fabric of the invention show temperature resistance, dimensional stability in spite of a very open weave, high air permeability, excellent tracking characteristics at high speeds and a high degree of abrasion resistance. Surprisingly, these advantageous properties are obtained in a fabric product which is substantially lighter and more flexible than fabrics previously employed to fabricate dryer belts. One would not ordinarily expect to obtain longer life and better durability in the lighter dryer belts of the invention. Furthermore, the light weight and better flexibility of dryer belts fabricated from fabrics of the invention provide for easy installation on existing textile dryers. The heavier prior art dryer belts are generally more difficult to install.

SUMMARY OF THE INVENTION

The invention comprises a highly air permeable, temperature resistant, open weave fabric which comprises; in a leno weave (i), warp yarns comprising temperature resistant synthetic organic fibers and (ii) crosswise yarns which comprise temperature resistant synthetic organic fibers braided over a core selected from glass fiber, metal wire and mixtures thereof; the yarns of said weave being coated with a temperature resistant polymeric synthetic resin. The fabrics of the invention are especially useful as dryer belts and the invention also comprises dryer belts fabricated from the fabrics of the invention.

The term "temperature resistant" as used herein means an ability to withstand temperatures of from about 100° F. to about 300° F. without substantial degradation.

The term "highly air permeable" as used throughout the specification and claims means an open area in the fabrics of the invention of at least about 35 percent.

DETAILED DESCRIPTION OF THE INVENTION

The fabrics of the invention are prepared according to the process of the invention by weaving the warp and crosswise yarns in a leno weave and then coating the woven fabric with a temperature resistant resin composition as specified in greater detail hereinafter. The woven fabric will have an average yarn count of 6 by 5 per square inch but can be within the range of 16 by 16 to 3 by 3 per square inch.

The warp yarns may be any multifilament yarn prepared from fibers of a synthetic organic polymeric resin which will not degrade significantly when exposed to temperatures of from 60° F. to about 300° F. Illustrative of such resin fibers are fibers of polyesters such as polyethylene terephthalate; fibers of acrylics such as polyacrylonitrile (Courtelle, Courtaulds Ltd., Great Britain); modacrylics such as Verel (Tennessee Eastman Company) and fibers of polyamides such as nylon 6,6 (polyhexamethylene adipamide). Mixtures of the above described fibers may also be used to make the fabrics of the invention.

In general, the warp fibers have a denier in the range of from about 840 to about 1680 and preferably within the range of from about 840 to about 1260. The warp yarns advantageously have a breaking strength of between about 40 to about 20 lbs. (min.) and preferably between about 30 to about 25 lbs. (min.). An elongation of between about 10 percent to 7 percent at 3 gms. per denier is most advantageous for the synthetic organic fibers employed in the warp yarns.

The crosswise yarns are prepared by braiding an organic polymeric synthetic fiber multifilament yarn, such as one within the scope of those described above for the warp yarns, over a core material. Preferred as the fiber in the crosswise yarn are those having the breaking strengths, elongation and denier set forth above as advantageous for the warp yarns.

The core materials used in the crosswise yarns may be glass fibers, individually or in a bundle, such as B glass, E glass and like fibers; metal wire such as chromel R, Rene 41, Halstelloy B, phosphorous bronze and the like; and combinations of the above. Preferred as the core material is a bundle of fiberglass (multiple glass fibers) with a single strand of phosphorous bronze wire. The fabrication of such composite yarns is well known in the art and need not be discussed here.

The woven fabric is coated by any conventional means of coating fabrics with a resin such as by dipping, spraying or doping with a temperature resistant resin composition hereinafter described. The coating is applied so as to completely and evenly encapsulate the warp and weft yarns and their component filaments without closing the spaces between adjacent yarns. This generally also serves to provide additional stability to the fabric by bonding the warp and weft yarns together at the crossover points.

The amount of resin applied is generally not critical, however, the fabrics of the invention advantageously are coated with resin in a proportion such that the fabric weight is increased by from about 5 percent to about 100 percent. Thus, the fabric of the invention has a weight of which from 2.5 to 50.0 percent comprises resin weight. Preferably the proportion of resin is such that the weight of the woven fabric is increased by from about 5 percent to about 30 percent. Thus, the preferred fabrics of the invention have a weight of which from 2.5 percent to 15 percent comprises resin weight.

The resin coating employed may be any temperature resistant resin coating composition from solutions, mixtures or dispersions of synthetic polymeric resins such as, for example, the coating composition of polyamide acids which upon curing yield a polyimide coating or a polyamide-imide coating (see for example U.S. Pat. Nos. 3,179,633; 3,179,634; 3,518,219; 3,541,036; 3,546,152; 3,652,500 and 3,702,788 disclosing such polyamide and polyamide-imide forming coating compositions).

Polyamide coating compositions such as nylon resin coatings may also be used in fabricating the dryer belts of the invention. Examples of nylon resin coating compositions are the copolymers of nylon 6,10 and nylon 6,6 dissolved in organic solvents such as aliphatic alcohols and mixtures of aliphatic alcohols with water.

Phenolic-aldehyde resins may also be employed to coat the warp and weft yarns in the fabrics of the invention. The resin is preferably applied from an aqueous or alcoholic solution. Among the phenolic-aldehyde resins which may be employed are resole and novalac resins, although if a novalac resin is employed it is necessary to provide additional aldehyde so as to contribute enough aldehyde to provide a molar ratio of aldehyde to phenol of at least 1 to 1 and thus impart thermo-setting characteristics to the phenolic-aldehyde resin. The resole or "A"-stage phenolic-aldehyde resins and the novolac resins are well known products, with which the resin chemist is familiar. The resole resins are produced by condensing a phenolic substance with a molecular excess of an aldehyde in the presence of an alkaline catalyst. Desirably the resole resin is produced by polymerizing at least about 1.1 moles of aldehyde for each mole of phenolic substance. In most cases it is not necessary to exceed a molar ratio of 1.5 to 1 of aldehyde to phenol. Larger ratios may be employed, but only at a loss in economy.

The phenolic component of the resin may be any mono- or poly-hydric phenol, preferably mononuclear, such as phloro-glucinol, resorcinol, orcinol, o-, m-, and p-cresols and, of course, phenol per se. The phenolic component should desirably be unsubstituted in at least one ortho or para position to a hydroxyl group, otherwise it is impossible to produce a cross-linked, thermosetting resin upon curing. Preferably, the phenolic component shall contain an average of at least about 2.2 unsubstituted reactive sites in the nucleus, i.e.; unsubstituted carbon atoms ortho and para to a hydroxyl group. Thus, ortho-creosol, which has one ortho and a para position unsubstituted, has two reactive sites. Phenol, per se, has two ortho positions and one para position unsubstituted for a total of 3 reactive sites. When ortho-cresol and phenol are employed as a mixture of phenolic components, the proportions of each are preferably calculated to provide a mixture containing an average of at least about 2.2 unsubstituted reactive sites.

The aldehyde component of the resole resin may be any aliphatic aldehyde containing up to 4 carbon atoms, such as propionaldehyde, acetaldehyde and formaldehyde. However, it is preferred to employ a lower aliphatic aldehyde containing not more than 2 carbon atoms. Formaldehyde is preferred. Formaldehyde may be employed in any of the commercial forms in which it is available. Thus, the aqueous solution, sold under the name formalin, which contains 37% by weight of formaldehyde in water with about 1 to 15% methanol added to prevent polymerization of the formaldehyde during storage, has been found to be very satisfactory for this purpose. Other aqueous solutions of formaldehyde containing various percentages of formaldehyde, such as 30 to 60% by weight, may also be employed. Also, other formaldehyde donors which liberate formaldehyde may be employed, such as the well-known paraformaldehyde and hexamethylenetetramine. Also, acrylic aldehyde and glyoxal may be used.

Preferred resin coatings for preparing the fabrics of the invention are the polyamide-imide polymers, more particularly described as polytrimellitamides, being prepared by the reaction of aromatic diamines with aryl halide derivatives of trimellitic anhydrides. The methods of their preparation are well known; see for example the methods of U.S. Pat. Nos. 3,049,518 and 3,260,691. Coating compositions of the preferred polytrimellitamide are generally well known and are commercially available (see for example the compositions of polytrimellitamide polymer enamel described in U.S. Pat. No. 3,451,848).

In addition to the temperature resistant resin applied as a coating to the woven fabric of the invention, other conventionally employed coating materials may be applied concurrently with the resin or in a separate treatment. For example, silicone compounds may be advantageously applied separately or concurrently with application of the temperature resistant resin coating to enhance characteristics of the fabrics of the invention. Such silicone compounds for enhancing release characteristics of synthetic fabrics are well known and are commonly employed in textile finishes.

The following examples describe the manner and process of making and using the invention and set forth the best mode contemplated by the inventors of carrying out the invention, but are not to be construed as limiting.

EXAMPLE 1

A. Weaving of Fabric

A 2 ply, 1200 denier continuous filament (weighing circa 0.101 gms. per 30 inches) of polyethylene terephthalate (Dacron, E. I. DuPont de Nemours and Co., Inc., Wilmington, Delaware) and comprised of 9.95 twist singles and 9.95 twist ply, is woven as the warp with a filling yarn of 4 end braid of 1200 denier continuous filament obtained from the same yarn described above for the warp, braided over a core consisting of a bundle of 75/1 fiberglass with a single strand of 0.008 inch diameter phosphorous bronze wire. The warp yarns are spaced in five groups of two yarns each per inch and woven on inverted doup leno harnesses to produce a half-twist between each crossover yarn insertion. The crossovers are inserted at six yarns per inch.

B. Coating of the Fabric

A treating solution is made by diluting a 30 percent solution of the polytrimellitamide polymer obtained by reaction of p,p'-diaminodiphenylmethane with trimellitic anhydride acid chloride in N-methylpyrrolidone (AI 1030, Amoco Chemicals Co., Chicago, Illinois) with sufficient N-methylpyrrolidone to obtain a polymer concentration of about 10 percent by weight. The fabric of Part A. supra., is impregnated with the treating solution so as to increase the fabric weight by 10 percent, after drying and curing the resin impregnated fabric. After treatment with the resin solution, the wet fabric is dried at a temperature of 150° F. and then cured at a temperature of about 350° F.

The fabric so obtained has an open area of at least about 35 percent, is light, flexible and resistant to abrasion.

EXAMPLE 2

Following the procedure of Example 1, supra, a fabric of the invention is prepared having a length of 133.3 feet and a width of 94.5 inches. The fabric is joined at the ends by a foldback pin seam to make an endless conveyor belt. The belt is easily installed in a tenter oven to support knit fabrics during heat setting. The belt operates at speeds of circa 90 yards per minute and at temperatures of between 100° –300° F. The belt tracks well, shows excellent dimensional stability and is highly resistant to abrasion. In particular, the belt shows excellent abrasion resistance on the edges, in contrast to open weave fiberglass belts coated with polytetrafluoroethylene which abrade on the edges while operated under the same conditions. The belt of this example also shows better dimensional stability, strength and track in comparison to the fiberglass belts coated with polytetrafluoroethylene. In comparison to a stainless steel wire belt, the belt of this Example 2 shows a better flex fatigue resistance and improved tracking characteristics.

Similarly, following the above procedure of Example 2 but replacing the polyethylene terephthalate yarns as used in Example 1 with yarns of acrylic, modacrylic or nylon, which will not degrade when exposed to temperatures of circa 300° F., endless conveyor belts are obtained which exhibit advantageous properties of air permeability, temperature resistance, flex fatigue, and high speed tracking.

The fabrics of the invention have also been found, unexpectedly, to be remarkably crease-resistant. This is a particularly advantageous property for endless conveyor belts fabricated from the fabrics of the invention.

What is claimed is:

1. An endless dryer belt which comprises a highly air permeable, temperature resistant leno weave fabric having i. warp yarns comprising temperature resistant synthetic organic fibers;

ii. crosswise yarns which comprise temperature resistant synthetic organic fibers braided over a core selected from glass fiber, metal wire and mixtures thereof;

iii. A coating of a temperature resistant polymeric synthetic resin on the yarns of said weave; and iv. the ends thereof joined together.

2. An endless dryer belt according to claim 1 wherein said warp yarns are selected from fibers of polyester, acrylic, modacrylic, nylon and mixtures thereof.

3. An endless dryer belt according to claim 1 wherein the fiber of said crosswise yarns is polyethylene terephthalate and the core of said crossover yarns comprise multiple glass fibers and a single strand of metal wire.

4. An endless dryer belt according to claim 1 wherein the fiber of said crosswise yarns is selected from polyester, acrylic, modacrylic and nylon fibers.

5. An endless dryer belt according to claim 3 wherein said metal wire is a phosphorous bronze wire.

6. An endless dryer belt according to claim 1 wherein said resin is a polyamide-imide.

7. An endless dryer belt according to claim 5 wherein said resin is a polytrimellitamide.

8. An endless dryer belt according to claim 6 wherein said resin is the reaction product of p,p'-diaminodiphenylmethane and trimellitic anhydride acid chloride.

9. An endless dryer belt according to claim 1 wherein said coating comprises from 2.5 percent to 50 percent of the weight of said fabric.

10. An endless dryer belt according to claim 1 wherein said coating comprises from 2.5 percent to 15 percent of the weight of said fabric.

11. An endless dryer belt according to claim 1 wherein said fibers (i) and (ii) have a denier of from about 840 to about 1680, a breaking strength of between about 40 to about 20 lbs. (min.) and an elongation of between about 10 percent to 7 percent at 3 gms. per denier.

12. A highly air permeable, temperature resistant, open weave fabric, which comprises:

in a leno wave, a. warp yarns comprising temperature resistant synthetic organic fibers; and b. cross-wise yarns which comprise temperature resistant synthetic organic fibers braided over a core selected from glass fiber, metal wire and mixtures thereof;.

the yarns of said weave being coated with a temperature resistant polymeric synthetic resin.

* * * * *